US009030519B2

(12) United States Patent
Narita et al.

(10) Patent No.: US 9,030,519 B2
(45) Date of Patent: May 12, 2015

(54) OPTICAL WRITING DEVICE AND IMAGE FORMING APPARATUS

(71) Applicants: Susumu Narita, Kanagawa (JP); Kazunori Bannai, Kanagawa (JP); Takeshi Yamakawa, Kanagawa (JP); Kazunori Watanabe, Tokyo (JP)

(72) Inventors: Susumu Narita, Kanagawa (JP); Kazunori Bannai, Kanagawa (JP); Takeshi Yamakawa, Kanagawa (JP); Kazunori Watanabe, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 24 days.

(21) Appl. No.: 14/278,319

(22) Filed: May 15, 2014

(65) Prior Publication Data

US 2014/0354757 A1 Dec. 4, 2014

(30) Foreign Application Priority Data

May 28, 2013 (JP) ..... 2013-112050

(51) Int. Cl.
*B41J 27/00* (2006.01)
*B41J 15/14* (2006.01)
*B41J 2/47* (2006.01)

(52) U.S. Cl.
CPC ..... *B41J 2/471* (2013.01)

(58) Field of Classification Search
USPC ..... 347/256–261, 241–243
See application file for complete search history.

(56) References Cited

U.S. PATENT DOCUMENTS 8,169,458 B2 * 5/2012 Itami et al. ..... 347/243

FOREIGN PATENT DOCUMENTS

| | | |
|---|---|---|
| CN | 101833263 A | 9/2010 |
| JP | 10020233 | 1/1998 |
| JP | 2002267989 A | 9/2002 |
| JP | 2005-092119 | 4/2005 |

OTHER PUBLICATIONS

Extended European Search Report dated Sep. 1, 2014.

* cited by examiner

*Primary Examiner* — Sarah Al Hashimi
(74) *Attorney, Agent, or Firm* — Harness, Dickey & Pierce, P.L.C.

(57) ABSTRACT

An optical writing device includes a light source, an optical deflector that deflects and scans light from the light source, a pre-deflector optical system that guides the light from the light source to the deflector, a post-deflector optical system that guides the scanned light to a target surface, a cover covering the deflector and including a first opening and a second opening provided at different positions, and a housing housing these optical elements. Light traveling from the light source to the deflector and the light scanned by the deflector are transmitted through the first opening but not through the second opening. During the rotation of the deflector, a forced inflow of air flowing from outside to inside the cover is generated in the first opening, and a discharged airflow flowing from inside to outside the cover is generated in the second opening.

7 Claims, 10 Drawing Sheets

OPTICAL WRITING DEVICE AND IMAGE FORMING APPARATUS

CROSS-REFERENCE TO RELATED APPLICATION

This patent application is based on and claims priority pursuant to 35 U.S.C. §119(a) to Japanese Patent Application No. 2013-112050, filed on May 28, 2013, in the Japan Patent Office, the entire disclosure of which is hereby incorporated by reference herein.

BACKGROUND

1. Technical Field

Embodiments of the present disclosure relate to an optical writing device that forms an electrostatic latent image on an image carrier based on image information and an image forming apparatus, such as a copier, a printer, a facsimile machine, a plotter, or a multifunction machine including at least one of these apparatuses, including the optical writing device.

2. Related Art

A polygon scanner (hereinafter also referred to as a polygon mirror) serving as an optical deflector employed in an optical writing device is a multifaceted mirror rotated at high speed by a motor that generates heat, thereby generating hot air and increasing the temperature of a nearby scanning lens or the like. Such an increase in the temperature of the scanning lens or the like is known to degrade magnification and other characteristics of scanning lines and cause color shift.

Measures addressing this issue include reducing the rotation rate of the polygon scanner to reduce the amount of heat generated by the polygon scanner and minimizing a so-called A-size of the polygon scanner; i.e., the radius of the polygon scanner to a mirror surface thereof. There is also a method of providing soundproof glass or the like to prevent transmission of the hot air from the polygon scanner to an optical element such as the scanning lens, to thereby block the hot air. However, the soundproof glass is disposed at a position at which a beam from a light source is not yet incident on the polygon scanner. Therefore, the soundproof glass needs to satisfy strict optical specifications. Moreover, in the case of an opposed scanning system, which typically includes two optical systems facing each other across the polygon scanner, two sheets of soundproof glass are required, which causes an increase in cost. Further, if the polygon scanner and surroundings thereof are enclosed by the soundproof glass, the transmission of the hot air to the scanning lens is suppressed, but the heat stays inside a space enclosing the polygon scanner, which limits the rotation rate and the continuous rotation time of the polygon scanner.

A substrate of the polygon scanner may be cooled from below by a fan, or a metal-based cover having high heat conductivity may be placed over the polygon scanner to release the heat. Either method, however, causes an increase in cost.

As a method of preventing the transmission of the hot air to the scanning lens without using the soundproof glass, an airflow guide member or the like may be employed to direct hot airflows generated from the polygon scanner away from the scanning lens. To prevent the transmission of the heat from the polygon mirror to the scanning lens through which a beam deflected and scanned by the polygon mirror is transmitted, a stepped guide member may be provided between the polygon mirror and the scanning lens to guide the hot airflows generated by the rotation of the polygon mirror toward a space above the scanning lens, without obstructing the beam.

However, it is necessary to dispose the stepped guide member so as not to obstruct the beam that is incident on the polygon mirror from the light source, scanned with the rotation of the polygon mirror, and reaching the scanning lens. That is, a portion of the stepped guide member on the path of the scanned beam needs to have an opening. Through the open portion of the stepped guide member allowing the transmission of the scanned beam, therefore, the hot air from the polygon mirror also reaches the scanning lens, causing a small but not significant increase in temperature.

SUMMARY in one embodiment of the present disclosure, there is provided an improved optical writing device that, in one example, includes a light source, an optical deflector, a pre-optical deflector optical system, a post-optical deflector optical system, a cover, and a housing. The optical deflector includes a mirror portion that has a plurality of deflecting surfaces and rotatable to deflect and scan light from the light source. The pre-optical deflector optical system guides the light from the light source to the optical deflector. The post-optical deflector optical system guides the light scanned by the optical deflector to a scan target surface. The cover covers the optical deflector and surroundings of the optical deflector, and includes at least one first opening and at least one second opening provided at different positions. The housing houses optical elements including the light source, the optical deflector, the pre-optical deflector optical system, the post-optical deflector optical system, and the cover. The light traveling from the light source to the optical deflector and the light deflected and scanned by the optical deflector are transmitted through the at least one first opening but not through the at least one second opening. During the rotation of the optical deflector, a forced inflow of air flowing from outside to inside the cover is generated in the at least one first opening, and a discharged airflow flowing from inside to outside the cover is generated in the at least one second opening.

In one embodiment of the present disclosure, there is provided an improved image forming apparatus that, in one example, includes an image carrier, the above-described optical writing device that forms an electrostatic latent image on the image carrier based on image data, and a development device that develops the electrostatic latent image to render the electrostatic latent image visible as a toner image to be transferred to and fixed on a recording medium.

BRIEF DESCRIPTION OF THE DRAWINGS

A more complete appreciation of the present disclosure and many of the advantages thereof are obtained as the same becomes better understood by reference to the following detailed description when considered in connection with the accompanying drawings, wherein.

DETAILED DESCRIPTION

Figure 1:
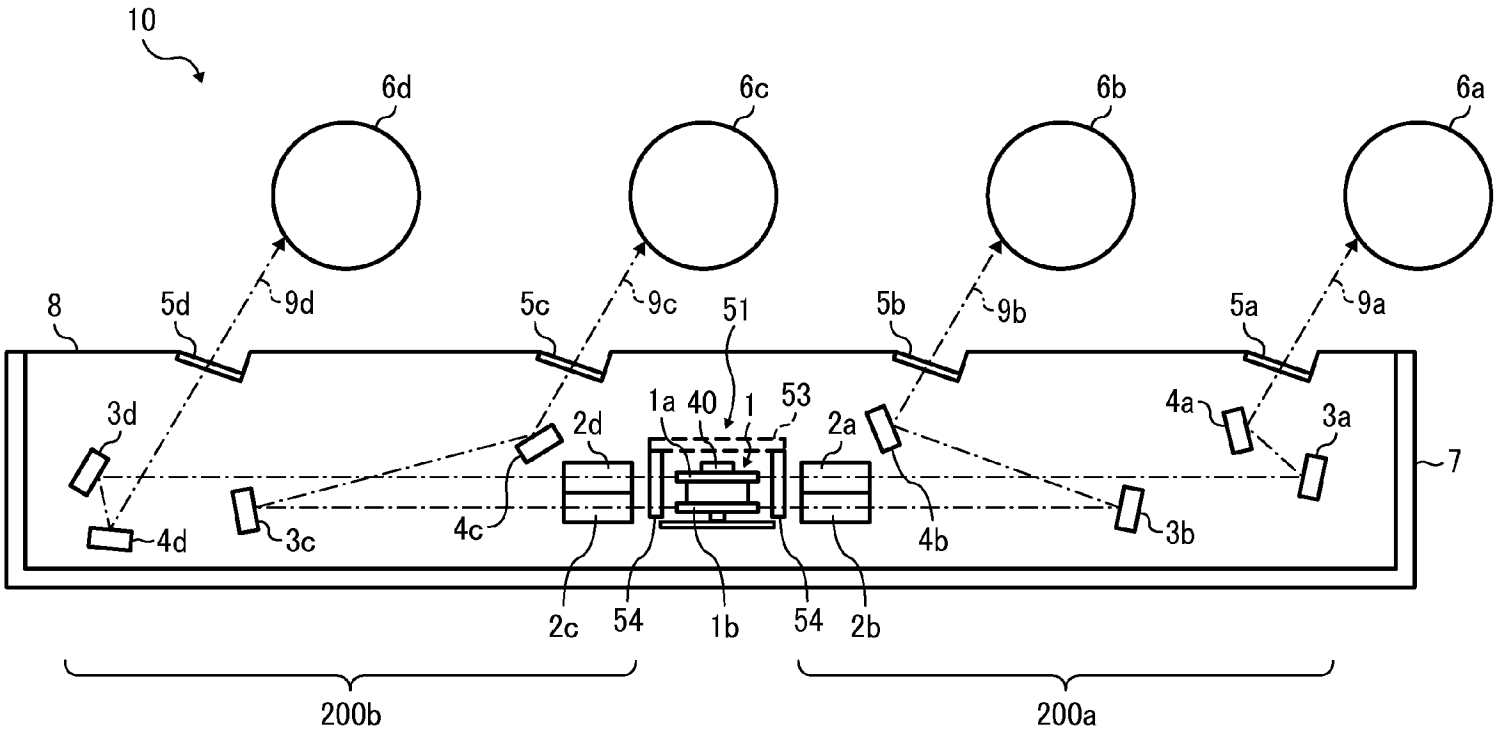
FIG. 1 is a schematic cross-sectional view of an optical writing device according to an embodiment of the present disclosure.

In describing the embodiments illustrated in the drawings, specific terminology is adopted for the purpose of clarity. However, the present disclosure is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, an embodiment of the present disclosure will be described.

FIG. 1 is a schematic configuration diagram of a digital color writing system serving as an optical writing device according to the present embodiment.

Figure 2:
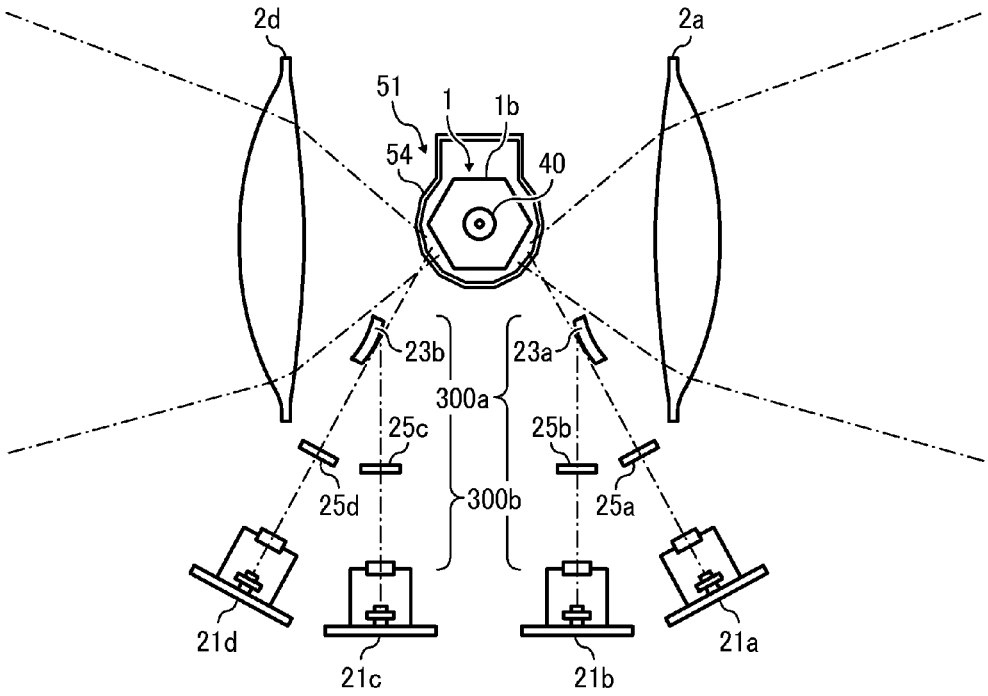
FIG. 2 is a schematic bottom view of a pre-optical deflector optical system of the optical writing device in FIG. 1

An optical writing device 10 employing an opposed scanning system includes a polygon scanner 1 serving as an optical deflector that rotates at high speed to deflect and scan laser beams from light sources 21*a*, 21*b*, 21*c*, and 21*d* illustrated in FIG. 2. The polygon scanner 1 includes mirror portions 1*a* and 1*b* each having a polygonal shape with side surfaces provided with reflecting mirrors (also referred to as deflecting surfaces or mirror surfaces). The mirror portions 1*a* and 1*b* are disposed around a rotary shaft 40 to be vertically spaced from each other.

The beams scanned by the polygon scanner 1 are transmitted through fθ lenses 2*a*, 2*b*, 2*c*, and 2*d* of post-optical deflector optical systems 200*a* and 200*b*, to convert equiangular motion of the scanned beams into uniform linear motion. The scanned beams transmitted through the fθ lenses 2*a*. 2*b*, 2*c*, and 2*d* are guided to photoconductor drums 6*a*. 6*b*, 6*c*, and 6*d*, which serve as scan target surfaces and image carriers, by mirrors 3*a*, 3*b*, 3*c*, 3*d*, 4*a*, 4*b*, 4*c*, and 4*d*.

The post-optical deflector optical system 200*a* includes the fθ lenses 2*a* and 2*b* and the mirrors 3*a*, 3*b*, 4*a*, and 4*b*, and the post-optical deflector optical system 200*b* includes the fθ lenses 2*c* and 2*d* and the mirrors 3*c*, 3*d*, 4*c*, and 4*d*. The fθ lenses 2*a*. 2*b*, 2*c*, and 2*d* are optical elements of the post-optical deflector optical systems 200*a* and 200*b*, through which the beams deflected and scanned by the polygon scanner 1 are first transmitted.

The above-described light sources 21*a*, 21*b*, 21*c*, and 21*d* in this embodiment include laser diodes (LDs), and the beams therefrom are incident on the mirror portions 1*a* and 1*b* of the polygon scanner 1 via pre-optical deflector optical systems 300*a* and 300*b* each having a commonly used configuration. For example, the pre-optical deflector optical system 300*a* includes cylindrical lenses 25*a* and 25*b* and a reflecting mirror 23*a*, and the pre-optical deflector optical system 300*b* includes cylindrical lenses 25*c* and 25*d* and a reflecting mirror 23*b*.

FIG. 1 also illustrates a later-described cover 51 including a wall 54 and a lid 53 to cover the polygon scanner 1, an optical housing 7 in which the above-described optical elements are disposed, dustproof glass plates 5*a*, 5*b*, 5*c*, and 5*d* that prevent dust and so forth from dropping into the optical housing 7, an upper lid 8 of the optical housing 7, and optical paths 9*a*, 9*b*, 9*c*, and 9*d* to the photoconductor drums 6*a*, 6*b*, 6*c*, and 6*d*.

As illustrated in FIG. 1, the optical writing device 10 according to the present embodiment has a configuration applicable to a tandem-type image forming apparatus having four photoconductor drums disposed therein.

Figure 3:
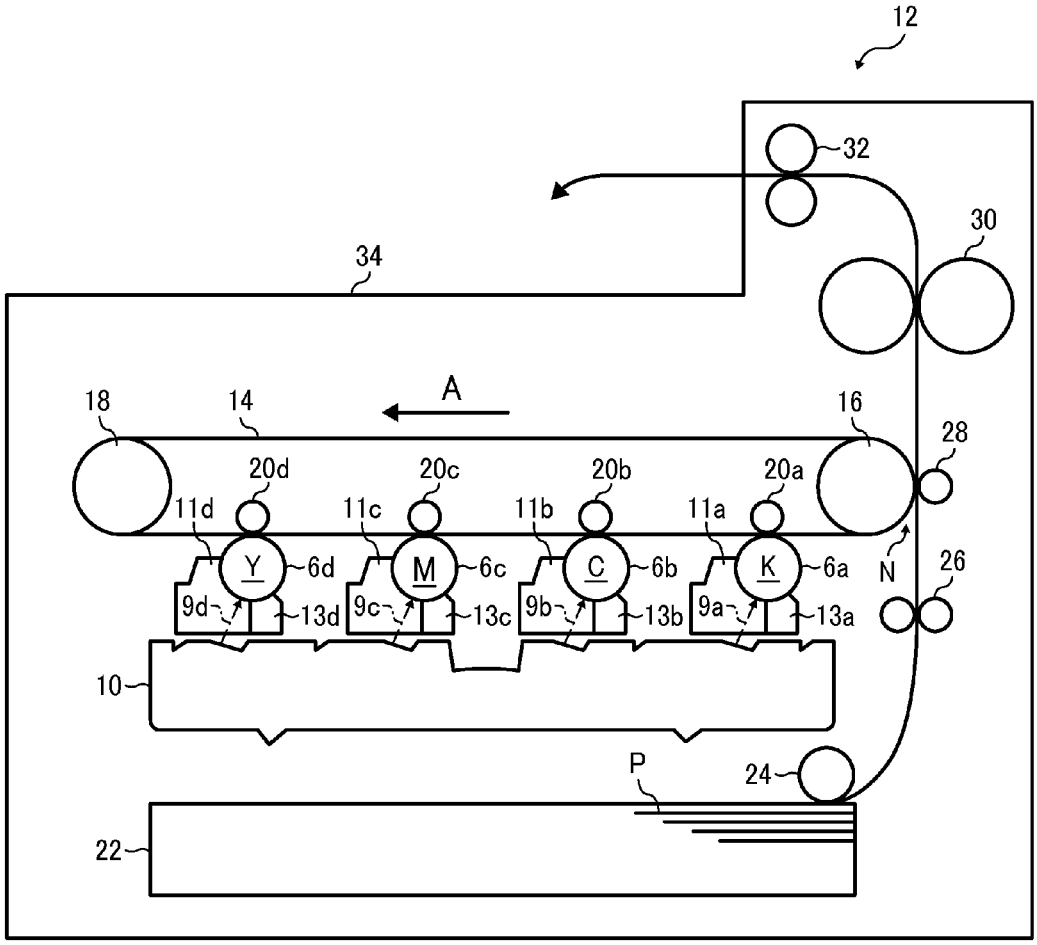
FIG. 3 is a schematic configuration diagram of an image forming apparatus including the optical writing device in FIG. 1.

FIG. 3 is a schematic configuration diagram of a digital color printer 12 serving as an image forming apparatus including the above-described optical writing device 10.

An intermediate transfer belt 14 serving as an intermediate transfer member is disposed on the photoconductor drums 6*a*, 6*b*, 6*c*, and 6*d*. The intermediate transfer belt 14 is wound around support rollers 16 and 18 and driven to rotate in the direction of arrow A.

Configurations commonly used to perform an image forming process, such as charging devices 13*a*, 13*b*, 13*c*, and 13*d* and development devices 11*a*, 11*b*, 11*c*, and 11*d*, are disposed around the photoconductor drums 6*a*, 6*b*, 6*c*, and 6*d*, respectively.

The photoconductor drums 6*a*, 6*b*, 6*c*, and 6*d* are uniformly charged by the charging devices 13*a*, 13*b*, 13*c*, and 13*d*, and electrostatic latent images are formed on the photoconductor drums 6*a*, 6*b*, 6*c*, and 6*d* by the optical writing device 10 based on image data of respective colors.

Thereafter, the electrostatic latent images are rendered visible as toner images by the development devices 11*a*, 11*b*, 11*c*, and 11*d*. Herein, the electrostatic latent images on the photoconductor drums 6*a*, 6*b*, 6*c*, and 6*d* are developed in colors of black (K), cyan (C), magenta (M), and yellow (Y), respectively. The order of the colors is not limited thereto.

The toner images of the respective colors are sequentially superimposed and transferred onto the intermediate transfer belt 14 by primary transfer devices 20*a*, 20*b*, 20*c*, and 20*d*.

Sheets P serving as recording media are fed one by one by a sheet feed roller 24 from a sheet feeding tray 22 disposed in a lower part of the body of the digital color printer 12. Each of the sheets P is then transported to a secondary transfer area N with predetermined timing by a registration roller pair 26.

At the secondary transfer area N, the color toner images on the intermediate transfer belt 14 are ultimately transferred at the same time onto the sheet P by a secondary transfer device 28. The sheet P bearing the toner images transferred thereto is transported to a fixing device 30, in which the toner images are fixed on the sheet P with heat and pressure applied thereto. The sheet P subjected to the fixing process is discharged and stacked by a sheet discharge roller pair 32 onto a sheet discharge tray 34 forming an upper surface of the body of the digital color printer 12.

Figure 4:
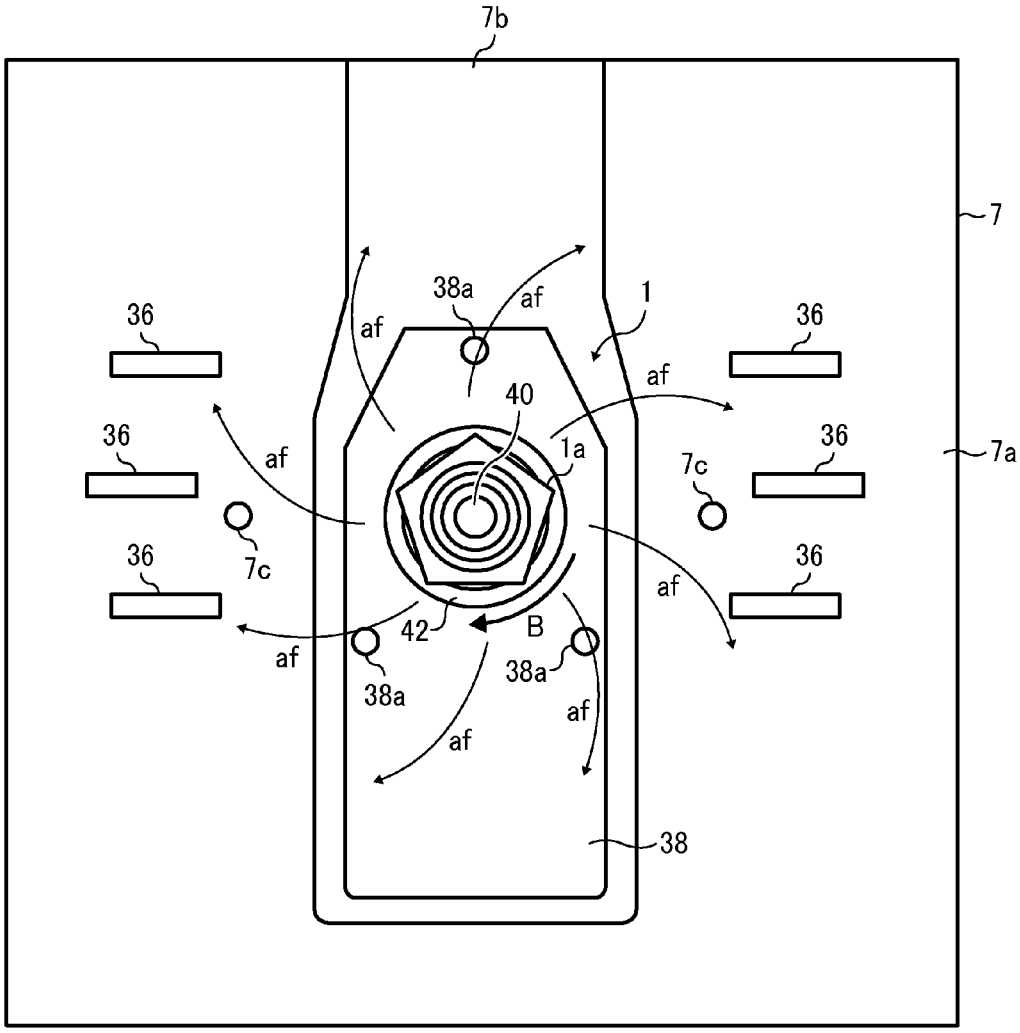
FIG. 4 is a schematic plan view of a polygon scanner of the optical writing device in FIG. 1 serving as an optical deflector.

FIG. 4 is a top view of the polygon scanner 1, illustrating a bottom surface 7*a* of the optical housing 7, a polygon installation area 7*b* recessed in or projecting from the bottom surface 7*a*, projections 36 on which the fθ lens 2*a*, 2*b*, 2*c*, and 2*d* (hereinafter also collectively referred to as the fθ lenses 2) are mounted, and insertion holes 7*c* in which screws or bolts are inserted to fix the optical housing 7 to the body of the digital color printer 12. In FIG. 4, the cover 51 is omitted for simplification.

The polygon scanner 1 includes a base 38 mounted on the polygon installation area 7*b* of the optical housing 7, the mirror portions 1*a* and 1*b* fixed to the rotary shaft 40 of a motor projecting from the upper surface of the base 38, and a motor rotor 42. The polygon scanner 1 is fixed to the bottom surface 7*a* of the optical housing 7 with screws inserted in screw insertion holes 38*a*.

The mirror portion 1*a* is provided on the upper side in the axial direction of the rotary shaft 40, and the motor rotor 42 is provided on the lower side in the axial direction of the rotary shaft 40. For easier comprehension, the following description will be given on the assumption that the polygon scanner 1 includes only one mirror portion, i.e., the mirror portion 1*a*.

As the polygon scanner 1 rotates in the direction of arrow B, the mirror surfaces of the mirror portion 1*a* push the air. As viewed from above, therefore, airflows of are formed in the same direction as the rotation direction of the polygon scanner 1.

Figure 5A:
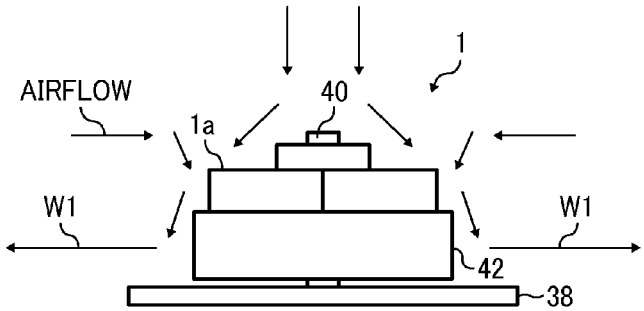
FIGS. 5A and 5B are diagrams illustrating airflows generated by rotation of polygon scanners, with FIG. 5A illustrating the polygon scanner in FIG. 4 in which the maximum radius of a motor rotor is greater than the circumradius of a mirror portion, and FIG. 5B illustrating a polygon scanner according to a comparative example in which the maximum radius of a motor rotor is less than the circumradius of a mirror portion.
Figure 5B:
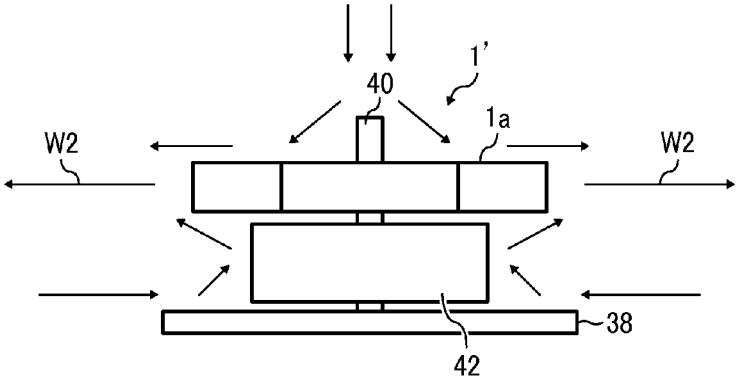
FIG. 5B RELATED ART

FIGS. 5A and 5B are side views of the polygon scanner 1 according to the present embodiment and a polygon scanner 1' according to a comparative example, respectively. FIG. 5A illustrates an example in which the maximum radius of the motor rotor 42 is greater than the circumradius of the mirror portion 1*a*. Experiments show that strong air currents w1 are generated at the position of the motor rotor 42 in this case owing to the greater radius of the motor rotor 42, thereby forming downward airflows. By contrast, in a case in which the circumradius of the mirror portion 1*a* is greater than the maximum radius of the motor rotor 42, as illustrated in FIG. 5B, strong air currents w2 are generated at the height of the mirror portion 1*a*. Which one of the circumradius of the mirror portion 1*a* and the maximum radius of the motor rotor 42 is greater is determined by the specifications of the employed optical system, the rotation rate of the polygon scanner 1, the height of the mirror portion 1*a*, and other specifications.

Figure 6:
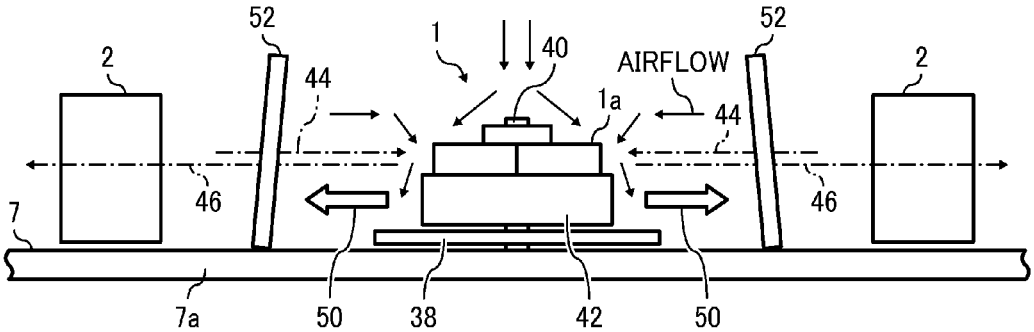
FIG. 6 RELATED ART
FIG. 6 is a diagram illustrating an issue of a configuration in which the polygon scanner and surroundings thereof are enclosed by soundproof glass.

With reference to FIG. 6, description will now be given of an issue of a typical countermeasure against the increase in temperature taken in a configuration using the polygon scanner 1 illustrated in FIG. 5A.

Beams 44 from the LDs are incident on the mirror portion 1*a* of the polygon scanner 1 and reflected by the mirror surfaces of the mirror portion 1*a*, and reflected beams 46 from the polygon scanner 1 travel toward optical elements such as the fθ lenses 2 serving as scanning lenses.

Meanwhile, strong hot air 50 blows radially outward from the center of the polygon scanner 1 at a height near a portion of the polygon scanner 1 having the maximum radius (i.e., the motor rotor 42 in this case). The hot air 50 blowing toward the optical elements such as the fθ lenses 2 hits and heats the optical elements, thereby degrading optical performance such as the main scanning magnification and the main scanning registration of scanning lines, which may cause image anomaly.

To prevent the hot air 50 from affecting the optical elements disposed downstream of the polygon scanner 1 in the beam traveling direction, therefore, soundproof glass 52 or the like having a high optical transmittance may be employed to block the hot air 50 while allowing the beams incident from the LDs and the beams scanned by the polygon scanner 1 to be transmitted through the soundproof glass 52.

This configuration prevents the hot air 50 from directly hitting the optical elements such as the fθ lenses 2 disposed downstream of the polygon scanner 1 in the beam traveling direction, but encloses a space around the polygon scanner 1 with the soundproof glass 52, confining the heat in the enclosed space, which limits the rotation rate and the continuous rotation time of the polygon scanner 1.

As a countermeasure against the heat, the base 38 of the polygon scanner 1 may be cooled from below by a fan, or a metal-based cover having high heat conductivity may be placed over the polygon scanner 1 to release the heat. Either method, however, causes an increase in cost.

To address this issue, the wall 54 of the cover 51 is provided around the polygon scanner 1 in the present embodiment, as illustrated in FIGS. 7, 8, 9, and 10.

Figure 9:
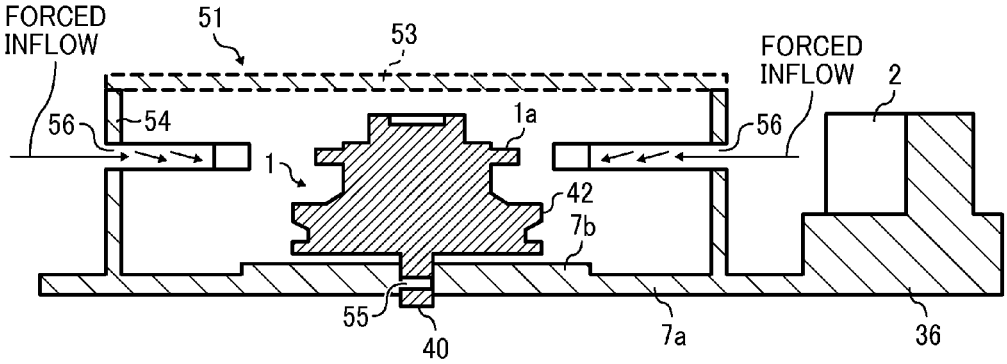
FIG. 9 is a cross-sectional view taken along a line IX-IX in FIG. 8.
Figure 10:
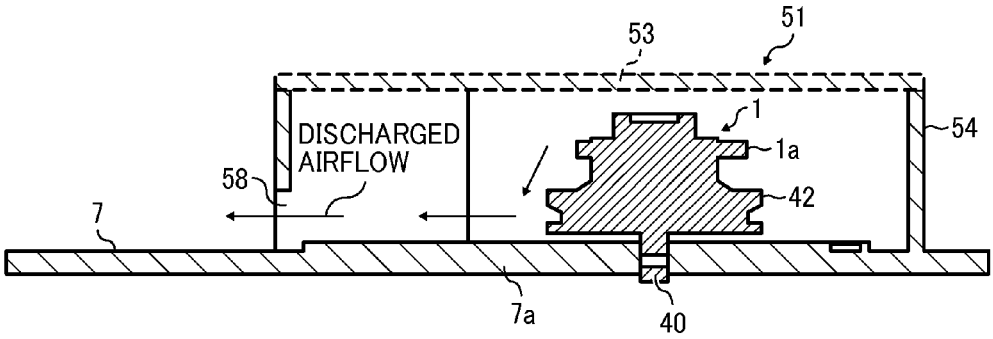
FIG. 10 is a cross-sectional view taken along a line X-X in FIG. 8.

The wall 54 has a lower surface covered by the bottom surface 7*a* of the optical housing 7 and an upper surface covered by the lid 53 illustrated in FIGS. 9 and 10. Therefore, the polygon scanner 1 is surrounded by a substantially enclosed space. Strictly speaking, the cover 51 consists of the lid 53 and the wall 54 that forms a main portion of the cover 51. Although the cover 51 does not necessarily require the lid 53, it is desirable to provide the lid 53 to the cover 51.

The wall 54 includes first openings 56 and a second opening 58 provided at a position different from the positions of the first openings 56. The beams incident from the LDs and the beams deflected and scanned by the polygon scanner 1 (i.e., the scanned beams) are transmitted through the first openings 56 without hitting the wall 54, but are not transmitted through the second opening 58.

As illustrated in FIG. 9, the first openings 56 are formed at positions facing the mirror portion 1*a* of the polygon scanner 1 in a direction perpendicular to the axial direction (i.e., height direction) of the rotary shaft 40.

In FIG. 9, reference numeral 55 denotes a shaft bearing for the rotary shaft 40. A portion of the motor rotor 42 having the maximum radius is located at a height closer to the shaft bearing 55 than the mirror portion 1*a*. If the portion of the motor rotor 42 having the maximum radius is located more distant from the shaft bearing 55 than the height of the mirror portion 1*a* is, the polygon scanner 1 is unbalanced to rotate. The portion of the motor rotor 42 having the maximum radius is therefore set at a position as close as possible to the shaft bearing 55 to make the polygon scanner 1 well balanced.

As illustrated in FIG. 10, the second opening 58 is formed at a position facing the motor rotor 42 of the polygon scanner 1 in the height direction.

In the present embodiment, a portion of the wall 54 excluding the second opening 58 has a polygonal shape close to a circular shape. The portion of the wall 54 excluding the second opening 58, however, may have a circular shape.

Since the polygon scanner 1 rotates at high speed, any sharp object or the like disposed near the polygon scanner 1 causes high-frequency noise. Further, the presence of an object having a shape causing resistance against the rotation of the polygon scanner 1 increases power consumption. Therefore, a portion of the wall 54 surrounding the polygon scanner 1 is formed in the circular shape or the near circular shape to thereby reduce the noise and power consumption.

As illustrated in FIG. 5A, the polygon scanner 1 according to the present embodiment is configured such that the maximum radius of the motor rotor 42 is greater than the circumradius of the mirror portion 1*a*. During the rotation of the polygon scanner 1 in this configuration, forced inflows of air flowing from outside to inside the cover 51 are generated in the first openings 56, and discharged airflows flowing from inside to outside the cover 51 are generated in the second opening 58.

Thereby, hot air generated by the polygon scanner 1 is guided to the second opening 58, and thus are prevented from directly hitting optical elements such as the fl) lenses 2 disposed downstream of the polygon scanner 1 in the beam traveling direction. Accordingly, the increase in temperature due to the hot air generated by the polygon scanner 1 is prevented. In other words, the second opening 58 is disposed to guide the discharged airflows away from the post-optical deflector optical systems 200*a* and 200*b*.

According to the present embodiment, the second opening 58 is disposed substantially on the opposite side to the light sources 21*a*, 21*b*, 21*c*, and 21*d* across the polygon scanner 1. It is desirable that there is no optical element near the second opening 58 serving as a port for discharging hot air. It is therefore preferable to dispose the second opening 58 in a portion of the wall 54 opposite to the light sources 21*a*, 21*b*, 21*c*, and 21*d*.

Further, a plurality of second openings 58 may be provided. In the present embodiment, the heat generated by the polygon scanner 1 is discharged with the discharged airflows discharged through the single second opening 58. The thus-discharged heat may excessively heat an area located in the direction of the discharged airflows. In that case, an additional second opening 58 may be formed in a different direction to discharge the hot air through the respective second openings 58 and thereby control the increase in temperature.

Figure 11:
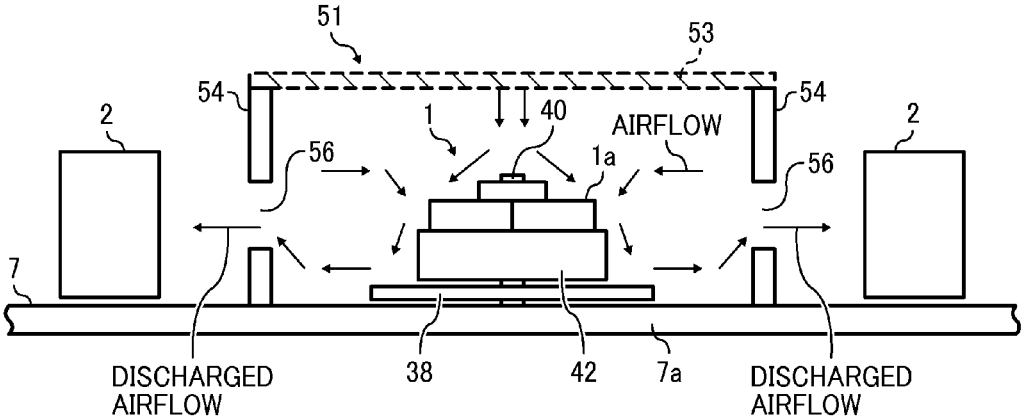
FIG. 11 RELATED ART
FIG. 11 is a diagram illustrating an issue of a configuration in which the cover includes only first openings.

As illustrated in FIG. 11, in a configuration in which the wall 54 includes only the first openings 56, the pressure inside the cover 51 is increased to form discharged airflows in the first openings 56, which transmits the hot air to the optical elements such as the fθ lenses 2. By contrast, in the present embodiment, the wall 54 includes the second opening 58 provided separately from the first openings 56. Thus, the hot air generated by the motor rotor 42 is discharged through the second opening 58, thereby forming forced inflows of air in the first openings 56 owing to the pressure distribution inside the cover 51.

The above-described airflows are obtained by appropriately designing the position of the wall 54 surrounding the polygon scanner 1 and the sizes and positions of the first openings 56 and the second opening 58 in accordance with the size (i.e., circumradius), height, and rotation rate of the mirror portion 1*a*.

Since strong air currents blow from near the height of the portion of the motor rotor 42 having the maximum radius, if the second opening 58 is disposed at a position according to the height of the portion of the motor rotor 42 having the maximum radius, the discharged airflows are likely to form in the second opening 58.

The cover 51 may be formed integrally with the optical housing 7 mounting other optical components, or may be formed separately from the optical housing 7. If the cover 51 and the optical housing 7 are integrally formed as a single unit, i.e., if the optical housing 7 includes the cover 51, the first openings 56, and the second opening 58, the configuration according to the present embodiment is obtained at minimum costs.

Figure 7:
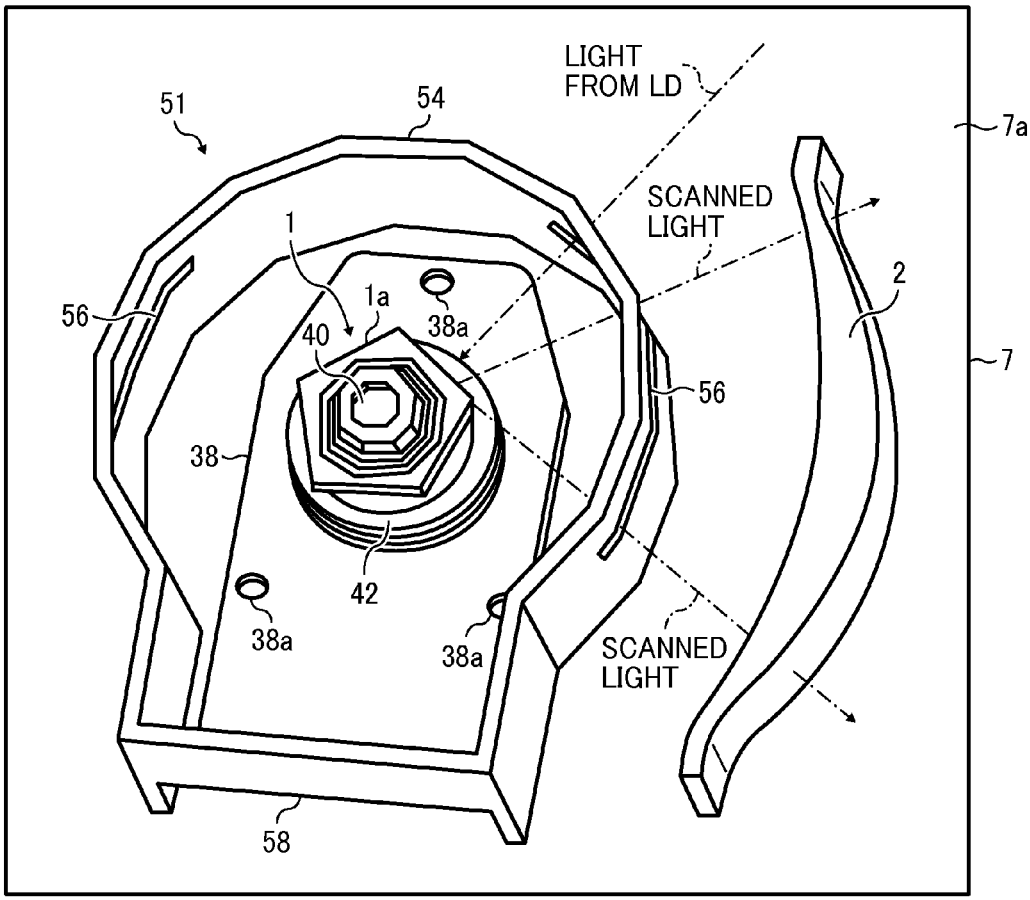
FIG. 7 is a partial perspective view of a cover covering the polygon scanner and surroundings thereof.
Figure 8:
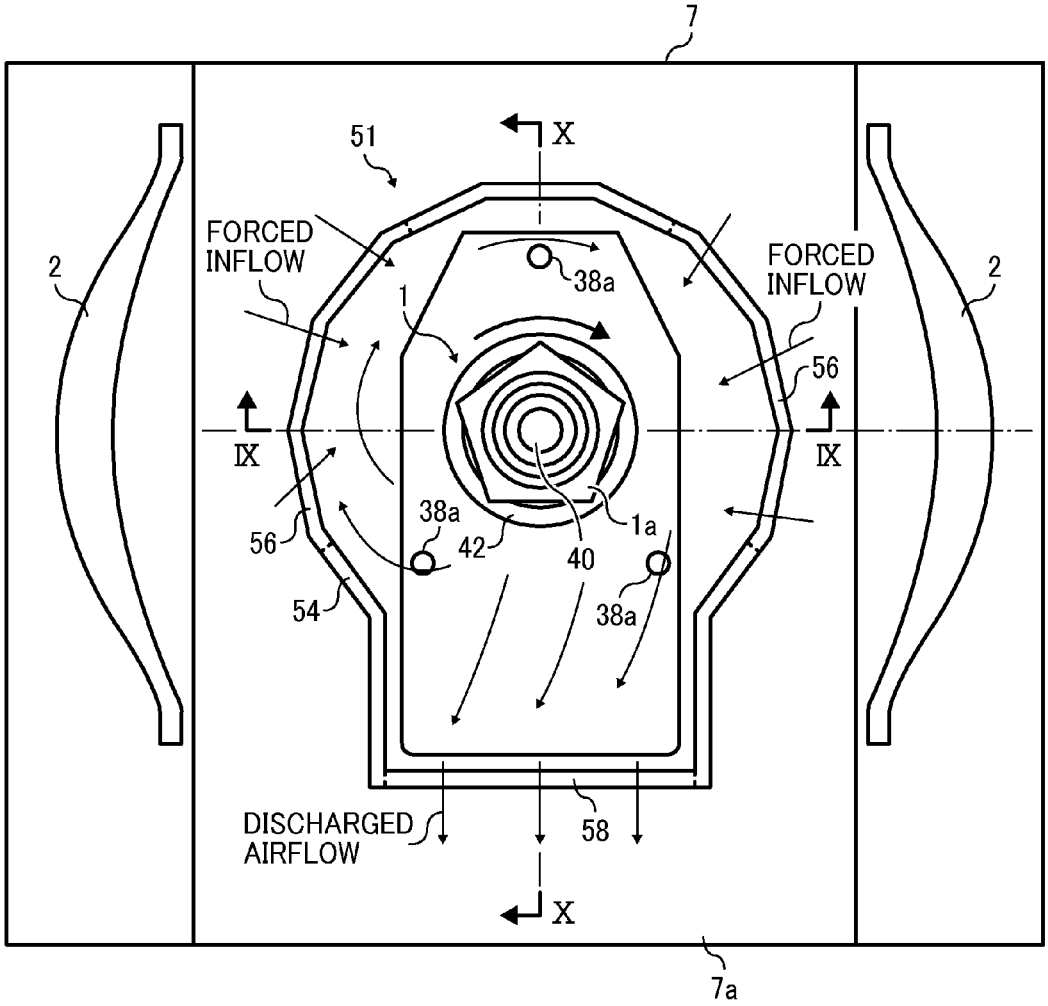
FIG. 8 is a partial plan view of the cover covering the polygon scanner and surroundings thereof.

When forming the cover 51 integrally with the optical housing 7, the wall 54 may be integrally formed with the bottom surface 7*a* of the optical housing 7, as illustrated in FIG. 7. However, it is difficult to form the lid 53 and the optical housing 7 at the same time. It is therefore desirable to form the lid 53 as a separate member.

In the above-described embodiment, the present disclosure is applied to an opposed scanning system having two optical systems for one optical deflector. The present disclosure, however, is also applicable to a scanning system having one optical system for one optical deflector. While the wall 54 includes two first openings 56 and one second opening 58 in the above-described embodiment, the wall 54 includes one first opening 56 and one second opening 58 in the scanning system having one optical system for one optical deflector.

Figure 12:
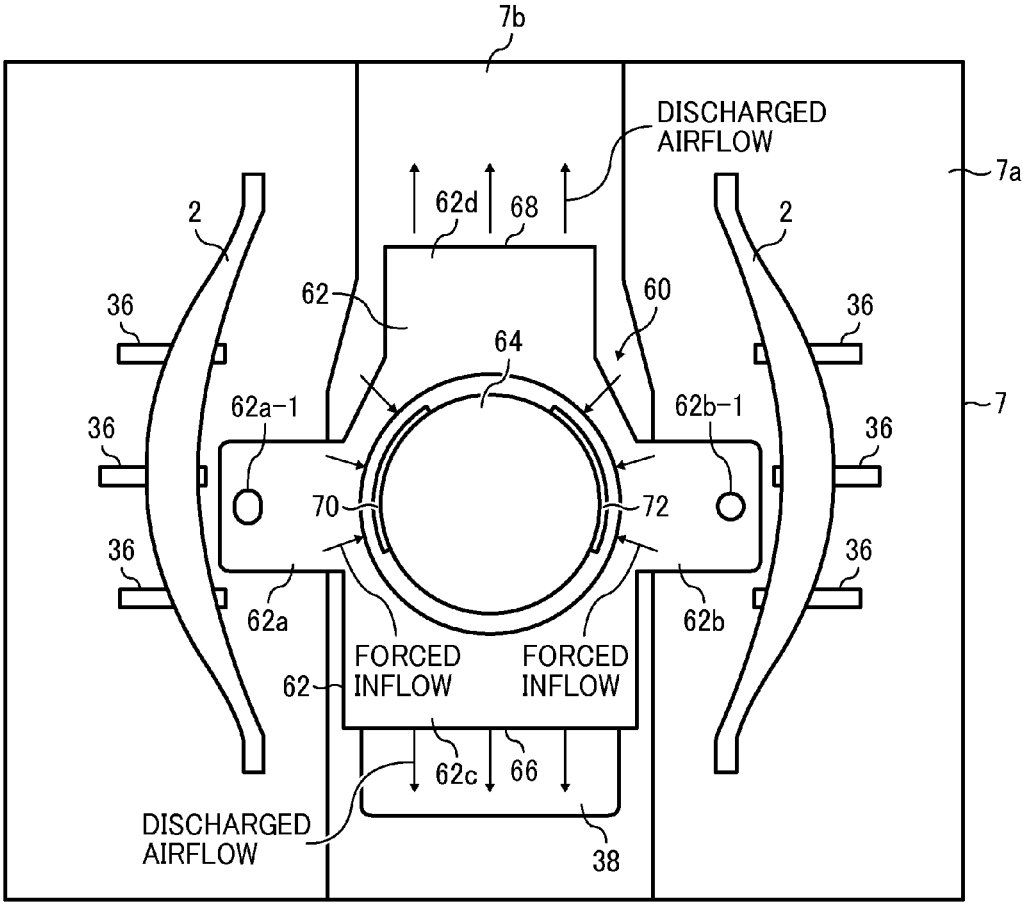
FIG. 12 is a plan view illustrating a modified example of the cover.
Figure 13:
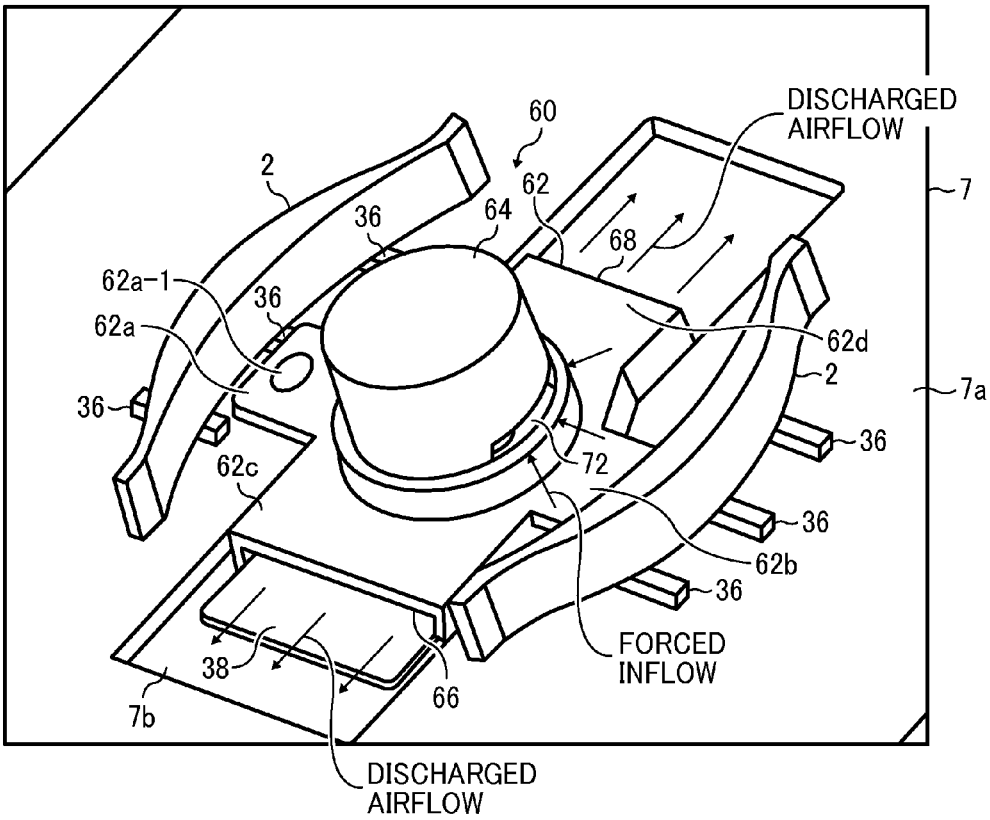
FIG. 13 is a perspective view of the modified example of the cover.

FIGS. 12 and 13 illustrate a cover according to a modified example constructed of different members.

A cover 60 according to the present example is separated from the optical housing 7 and shaped to cover the polygon scanner 1. The cover 60 includes a leg 62 and a cylindrical cap 64. The leg 62 is disposed on the polygon installation area 7*b* of the optical housing 7 to rise from the bottom surface 7*a* of the optical housing 7. The cap 64 substantially vertically rises from a central area of the upper surface of the leg 62.

The leg 62 includes fixing portions 62*a* and 62*b* to be fixed to the optical housing 7 and discharge portions 62*c* and 62*d* extending perpendicular to the fixing portions 62*a* and 62*b*. The leg 62 as a whole has a cross shape.

The fixing portions 62*a* and 62*b* are respectively formed with insertion holes 62*a*-1 and 62*b*-1 in which screws or bolts are inserted. The insertion hole 62*a*-1 is elongated for adjustment purposes.

Rectangular second openings 66 and 68 are formed under the discharge portions 62*c* and 62*d*, i.e., between the discharge portions 62*c* and 62*d* and the bottom surface 7*a* of the optical housing 7.

First openings 70 and 72 are formed in the side surface of the cap 64 at positions facing the fθ lenses 2.

With this configuration, ascending heat generated from the polygon scanner 1 is prevented from propagating inside the optical writing device 10 and increasing the temperature of the fθ lenses 2. That is, the ascending heat is confined inside the cylindrical cap 64 and moved out with discharged airflows discharged through the second openings 66 and 68. Accordingly, the increase in temperature is effectively suppressed.

Further, if the cover 60 is configured as a separate member from the optical housing 7, it is possible to prevent heat propagation to the fθ lenses 2 and so forth by selecting, as the material of the cover 60, a substance or material lower in heat conductivity than the substance or material of the optical housing 7.

In an opposed scanning system, beams from LDs are incident on a polygon scanner from two directions, and thus two first openings are provided, as described above. Such a configuration having multiple first openings is capable of generating forced inflows of air in the first openings similarly as in a configuration having one first opening.

In this case, the two first openings may be connected. An increase in size of the first opening, however, reduces the force of the forced inflows of air. Therefore, caution is required when forming the first opening larger than the size of optical path.

Similarly, a configuration having multiple second openings, such as the example illustrated in FIGS. 12 and 13, is capable of generating discharged airflows in the second openings similarly as in a configuration having one second opening. Further, if the second opening is formed in a direction perpendicular to the rotary shaft 40 of the polygon scanner 1, rotating airflows are discharged without a pressure loss.

In a polygon scanner in which the circumradius of the mirror portion 1*a* is greater than the maximum radius of the motor rotor 42, as in the polygon scanner 1' according to a comparative example illustrated in FIG. 5B, air currents from the height of the mirror portion 1*a* are stronger than air currents from the height of the motor rotor 42. In such a configuration, therefore, it is difficult to prevent hot air from blowing out through the first openings that allow the transmission of beams.

An optical writing device according to an embodiment of the present disclosure is capable of highly accurately minimizing transmission of hot air generated by rotation of an optical deflector to a post-optical deflector optical system including a scanning lens.

According to an embodiment of the present disclosure, it is possible to minimize an increase in temperature of the post-optical deflector optical system due to the heat generated by the rotation of the optical deflector, and thus highly accurately minimize deterioration of characteristics of scanning lines such as magnification and color shift.

The above-described embodiments are illustrative and do not limit the present disclosure. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the present disclosure may be practiced otherwise than as specifically described herein.

What is claimed is:

1. An optical writing device comprising:

a light source;

an optical deflector including a mirror portion that has a plurality of deflecting surfaces and rotatable to deflect and scan light from the light source;

a pre-optical deflector optical system to guide the light from the light source to the optical deflector;

a post-optical deflector optical system to guide the light scanned by the optical deflector to a scan target surface;

a cover to cover the optical deflector and surroundings of the optical deflector, the cover including at least one first opening and at least one second opening provided at different positions; and a housing to house optical elements including the light source, the optical deflector, the pre-optical deflector optical system, the post-optical deflector optical system, and the cover, wherein the light traveling from the light source to the optical deflector and the light deflected and scanned by the optical deflector are transmitted through the at least one first opening but not through the at least one second opening, and wherein, during the rotation of the optical deflector, a forced inflow of air flowing from outside to inside the cover is generated in the at least one first opening, and a discharged airflow flowing from inside to outside the cover is generated in the at least one second opening.

2. The optical writing device according to claim 1, wherein the post-optical deflector optical system includes a plurality of optical elements, and the at least one first opening is located between the optical deflector and an optical element of the post-optical deflector optical system, through which the light deflected and scanned by the optical deflector is first transmitted.

3. The optical writing device according to claim 2, wherein the at least one second opening is disposed to guide the discharged airflow away from the post-optical deflector optical system.

4. The optical writing device according to claim 1, wherein the optical deflector further includes a motor rotor and a rotary shaft having the mirror portion and the motor rotor fixed thereto, with the mirror portion disposed above the motor rotor in an axial direction of the rotary shaft, wherein a maximum radius of the motor rotor is greater than a circumradius of the mirror portion, and wherein the at least one first opening is disposed at a position facing the mirror portion in a direction perpendicular to the rotary shaft, and the at least one second opening is disposed at a position facing the motor rotor in the direction perpendicular to the rotary shaft.

5. The optical writing device according to claim 1, wherein the cover is made of a material that has a lower heat conductivity than that of a material forming the housing.

6. The optical writing device according to claim 1, wherein at least one of the at least one first opening and the at least one second opening comprises a plurality of openings.

7. An image forming apparatus comprises:

an image carrier;

an optical writing device to form an electrostatic latent image on the image carrier based on image data; and a development device to develop the electrostatic latent image to render the electrostatic latent image visible as a toner image to be transferred to and fixed on a recording medium, wherein optical writing device comprises:

a light source;

an optical deflector including a mirror portion that has a plurality of deflecting surfaces and rotatable to deflect and scan light from the light source;

a pre-optical deflector optical system to guide the light from the light source to the optical deflector;

a post-optical deflector optical system to guide the light scanned by the optical deflector to a scan target surface;

a cover to cover the optical deflector and surroundings of the optical deflector, the cover including at least one first opening and at least one second opening provided at different positions; and a housing to house optical elements including the light source, the optical deflector, the pre-optical deflector optical system, the post-optical deflector optical system, and the cover, wherein the light traveling from the light source to the optical deflector and the light deflected and scanned by the optical deflector are transmitted through the at least one first opening but not through the at least one second opening, and wherein, during the rotation of the optical deflector, a forced inflow of air flowing from outside to inside the cover is generated in the at least one first opening, and a discharged airflow flowing from inside to outside the cover is generated in the at least one second opening.

* * * * *